United States Patent [19]

Morton

[11] Patent Number: 4,611,510

[45] Date of Patent: Sep. 16, 1986

[54] TOOL FOR REMOVING PACKING

[76] Inventor: Ronald R. Morton, 2746 Chryslar, Cape Girardeau, Mo. 63701

[21] Appl. No.: 763,391

[22] Filed: Aug. 7, 1985

[51] Int. Cl.[4] ..... B25B 33/00

[52] U.S. Cl. ..... 81/8.1

[58] Field of Search ..... 81/8.1; 29/270

[56] References Cited

U.S. PATENT DOCUMENTS

| | | | |
|---|---|---|---|
| 1,165,041 | 12/1915 | Toon | 81/8.1 |
| 1,195,220 | 8/1916 | Hendren | 81/8.1 |
| 2,822,713 | 2/1958 | Schmidt | 81/8.1 |
| 3,149,514 | 9/1964 | Shaub | 81/8.1 |
| 3,443,460 | 5/1969 | Johnson | 81/8.1 |

*Primary Examiner*—James L. Jones, Jr.
*Attorney, Agent, or Firm*—Paul M. Denk

[57] ABSTRACT

A tool for removing packing from a feed tube including a cylindrical like member, generally formed of a pair of semi-cylindrical halves, each of the halves held together along adjacent edges by means of a hinge, the opposite adjacent edges of each cylindrical half having an extending ear through which a fastening member may locate for securing the cylindrical like member about the supporting tube, and a locking member for securing the cylindrical like member in place and for positioning of its forwardly extending piercing members for projecting into and cutting out packing from around the supporting tube and its stuffing box.

6 Claims, 10 Drawing Figures

TOOL FOR REMOVING PACKING

BACKGROUND OF THE INVENTION

This invention relates generally to the construction, operation and usage of a tool for removing packing particularly under those conditions where the packing is utilized for suppressing hot gasses under pressure, and therefore, as any such packing is removed, the workers are exposed to heat and frequent injury when the procedure is performed under manual conditions.

To expand upon the foregoing, in small power houses where electrical charge or heating requirements are generated or obtained through the use of a furnace for heating water to create steam, or the like, for operations of one or more generators, maintenance requires that the furnace be subjected to periodic cleaning, in order to sustain its efficient operations. To achieve such, and particularly where soot builds up along the inner walls for the furnace, during the water heating procedure, an auxillary mechanism generally defined as a blower formed of a lance tube and feed tube are mounted onto the furnace, extending laterally therefrom, and the lance tube is disposed for extending into the furnace, through its wall, and once interiorly thereof, air under significant pressures, such as in the range of 100 to 200 psi, are released within the furnace as a means for blowing air onto the furnace interior walls, to eliminate and remove soot from the same, which then is exhuasted from the furnace by means of a stack, or the like. But, as can be understood, such a lance tube moves longitudinally within and without the wall of the furnace, while the feed tube is generally maintained stationary, acting as a support upon which the first mentioned tube moves, while slightly rotating, as it shifts into or out of the furnace wall. In order to maintain air under these significant pressures within the tubes, and to prevent their leaking, a stuffing box is usually supported by a carriage, at the back end of the lance tube, and is rotated by means of a drive shaft, through an interconnecting chain drive, which rotates the stuffing box and the lance tube at some degree of turn, and as this occurs, the chain drive moves upon the drive shaft longitudinally, pulling the lance tube either forwardly and into the furnace, through its wall, or when reversed in operation retracting the same from the furnace. Thus, as can be understood, the high pressure gases or air being delivered through the feed tube, and to the lance tube, is sealed within these tubes by means of the packing maintained within the stuffing box, and which seals the back end of the of lance tube, about the feed tube, so as to prevent the escape of any air therefrom, or in the alternative, should the lance tube be arranged within the furnace, and receive hot gasses therefrom, to prevent the escape of any hot furnace gasses that pass to the stuffing box, through the arrangement of its packing thereat, which under normal circumstances, could easily burn any worker within the vicinity, should a leak occur.

On the other hand, it sometimes becomes necessary to repack the stuffing box between these two tubes, and heretofore this operation has been performed simply through the use of manually operated chisels, which are hammered into the packing so as to piecemeal remove it, which not only is a very time consuming procedure, but likewise, should any hot gasses be present from the furnace and in the tubes, and leak out around the packing, as it is being removed, worker injury frequently has and does occur. It is for this reason the current invention has been designed to provide a mechanical means for totally removing packing from within such a stuffing box, so as to provide sufficient distance between the worker, and these operating components, during this procedure, and minimize, if not totally eliminate, any worker exposure to harm, and likewise, significantly accelerate the removal of any such packing and repacking of like materials into the stuffing box for ready application of the soot blower.

It is therefore, the principal of the invention to provide a tool for removing packing from a stuffing box used in conjunction with hot pressurized air feeds, particularly to a furnace means.

Another object of this invention is to provide a tool that is rigidly held in place, sturdily through the use of fastening and locking means, but likewise, is formed of semi-cylindrical halves, and therefore can be readily removed after usage or replaced into position through a minimum of effort and time.

Still another object of this invention is to provide a tool for removing packing, which integrally incorporates a series of piercing means that can mechanically dig into the packing maintained within a stuffing box so as to automatically remove such packing therefrom prior to a repacking of a soot blower, particularly as used in conjunction with a furnace or heater.

These and other objects will become more apparent to those skilled in the art upon reviewing the summary of this invention, and upon undertaking a study of the description of its preferred embodiment in view of the drawings.

SUMMARY OF THE INVENTION

This invention contemplates the formation of a tool for use in conjunction with a soot blower, and which is useful for removing spent packing that is beginning to fail, so that the packing can be replaced for more efficient operations of the carriage means used in conjunction with a such a blower. This tool is a cylindrical like member, preferably formed of a pair of semi-cylindrical halves, being hinged along a pair of adjacent side edges, so that the device can be easily opened for insertion onto a tube of the soot blower, or simply pivoted open, for removal of the same after completion of its task. Each semi-cylindrical halve incorporates a piercing member extending forwardly therefrom, having a reasonably sharpened point or edge at their forwardmost ends, and which are aligned with the packing maintained within the stuffing box of such a blower, so as to pierce the packing and provide for its automatic removal thereby eliminating the necessity of the worker having to perform such tasks manually through the use of a hammer and chisel, as previously explained. The opposite side edges of the pair of semi-cylindrical halves for the tool incorporate fastening means, such as integral extending ears or boss like means through which a bolt or other fastener may insert, through each aligned pair of ears, in order that the tool can be snugly secured onto one of the tubes of the soot blower, and held in place by means of a locking means. The locking means may be pivotally connected onto one of the bolts fastening a pair of semi-cylindrical means ears together, with the locking means being manually forced through pulling into a locking position onto the supporting tube, to hold the same stationarily in place, as the stuffing box and lance tube for the blower is retracted, rearwardly, until such time as the cutting edges of the piercing means dig into the packing and automatically provides for its cutting and removal from its retention in the stuffing box. When that function is complete, the tool can be removed, or the stuffing box shifted forwardly, to disengage it from the tool, and new packing can be immediately located into the stuffing box for sealing this location between the concentric lance and feed tubes for the soot blower.

DESCRIPTION OF THE PREFERRED EMBODIMENT

Figure 1:
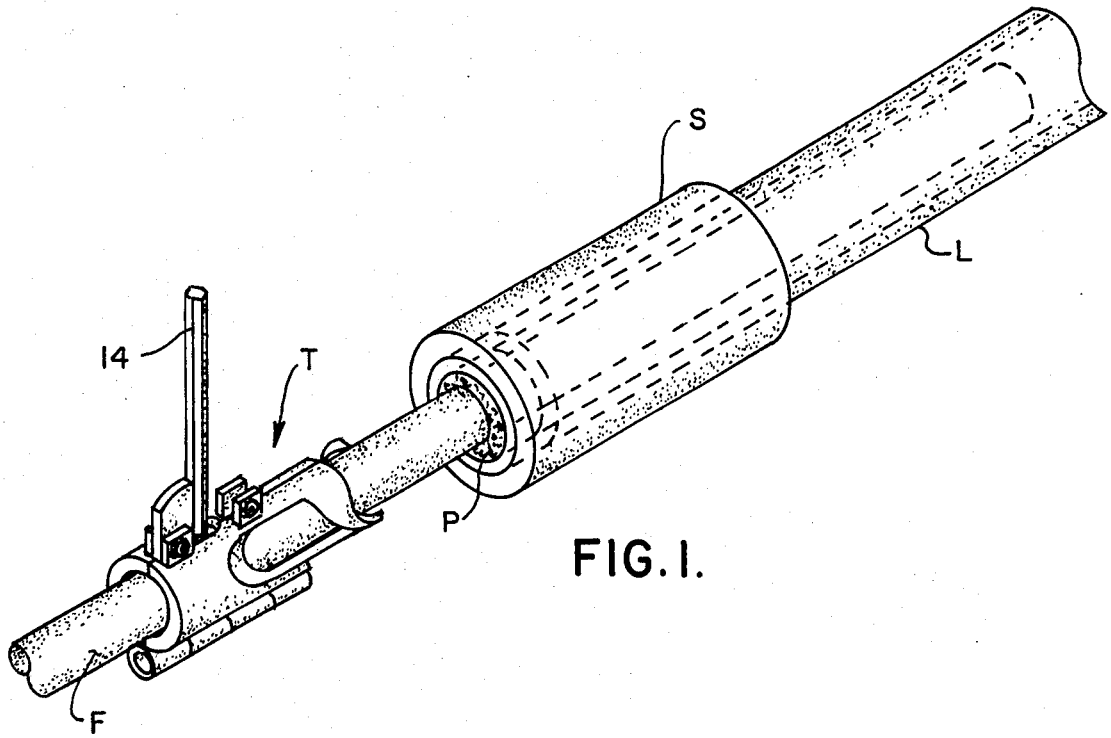
FIG. 1 discloses an isometric view of the tool located in place upon a feed tube, ready to remove the packing from a rearwardly shifting stuffing box and lance tube for a soot blower.

In referring to the drawings, and in particular FIG. 1, the tool T of this invention is shown mounted upon a feed tube F for a common soot blower, the type that functions off a carriage for shifting longitudinally of its concentrically arranged lance tube L and its stuffing box S forwardly until said lance tube enters into the wall of a furnace, and functions to aid in the removal of soot, and the like, as previously explained. The essence of this invention is to provide means for automatically removing, without too much manual participation, the packing P that is compacted between the stuffing box S and the back end of the lance tube L, where it concentrically is arranged over and sealed upon the feed tube F, as shown in said figure. As can be seen, as the lance tube and its stuffing box are retracted by means of carriage means (not shown) from within the furnace, and moves rearwardly, the front edges of the tool T encounter the packing, dig into it, and achieve its removal, thereby eliminating the need for the worker to manually chisel out any such packing from its emplacement.

Figure 8:
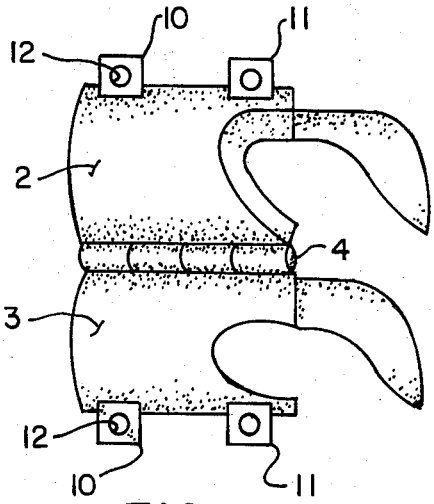
FIG. 8 is a view of the cylindrical like member forming the tool of FIG. 7, but pivoted into an opened configuration, as when being inserted or withdrawn from the feed tube.
Figure 9:
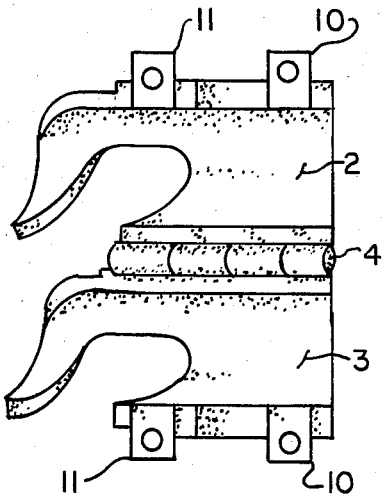
FIG. 9 is the opposite side view of the opened cylindrical like member shown in FIG. 8.

The actual tool of this invention is also shown in FIGS. 2 through 6, and in its various views as previously explained. Essentially, the tool is formed of a cylindrical like member 1, formed of two semi-cylindrical halves 2 and 3, as also shown in FIGS. 8 and 9, and which are hinged together proximate adjacent edges, by means of an integrally formed hinge means 4. Extending integrally from the forward edges of each halve 2 and 3 are the piercing members 5 and 6, respectively, and which each incorporates a sharpened edge, as at 7, useful for cutting into the packing material as it comes into contact with this portion of the identified tool. As can be seen, these members 5 and 6 extend rather helically from their respective cylindrical halves, so that as the packing material is being cut from its embedment within the stuffing box, the piercing edges 7 have a tendency to shave said packing material from its location and provide clearance for its shavings as it is dug from the stuffing box. Each member 5 and 6 has sufficient length to extend deeply into the stuffing box and achieve removal of the emplaced packing. As can be seen, there is adequate clearance provided downwardly from the curved sections 8 of each piercing member, and which is cut rearwardly into each respective cylindrical half, as noted at 9. This is provided, as previously explained, to provide room for movement of the shavings of the packing material as it is cut from the stuffing box, during penetration of the members 5 and 6, and more specifically their cutting edges into the confined packing material.

As can also be seen from the various figures, each cylindrical half has at least one, but preferably two, extending ears 10 and 11, with each ear or projecting member having an aperture provided therethrough, as at 12, with said apertures 12 provided for alignment as the cylindrical halves are pivoted together, into closure, about the feed tube F, as shown in FIG. 1. Then, a fastening means, such as a bolt, such as 13, are disposed for inserting through the aligned apertures of each pair of ears, so that the cylindrical like member can be locked into position upon the feed tube, as noted.

Figure 2:
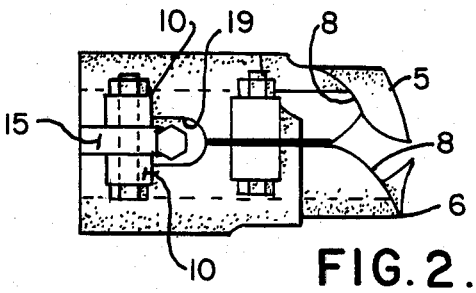
FIG. 2 is a top view of the identified tool of FIG. 1.
Figure 3:
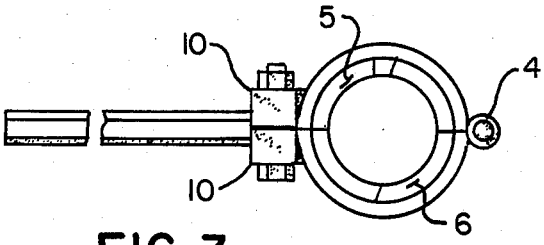
FIG. 3 is a front view of the tool of FIG. 1.
Figure 4:
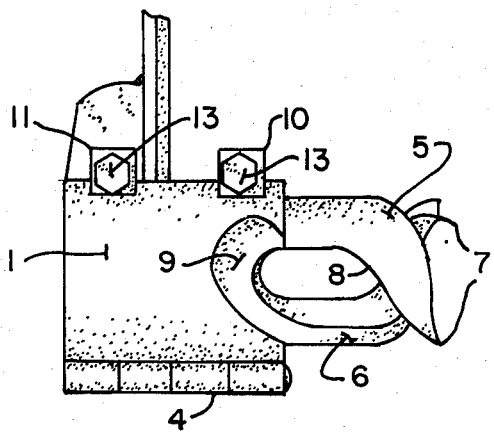
FIG. 4 is a side view of the tool of FIG. 1.
Figure 5:
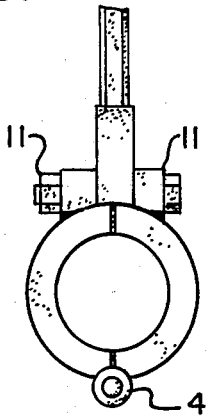
FIG. 5 is a back view of the tool of FIG. 1.
Figure 6:
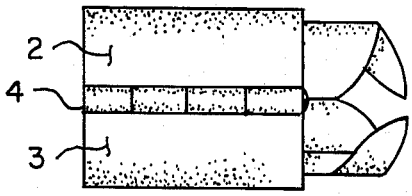
FIG. 6 is a bottom view of the tool of FIG. 1.
Figure 7:
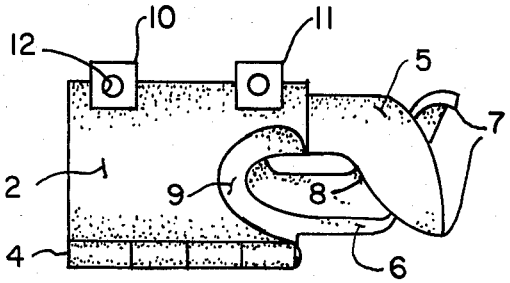
FIG. 7 is a side view of the tool shown in FIG. 4, with the locking means and fastening means removed.
Figure 10:
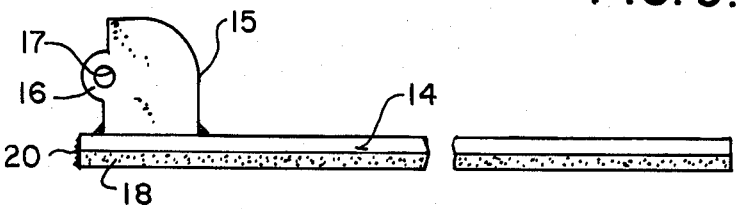
FIG. 10 is side view of the locking means of this invention.

The locking means for use for manipulation by the worker and for holding the cylindrical like member into position for functioning as a means for removing the packing is more accurately disclosed in FIG. 10. It includes a length of rod 14, and has a flange member 15 integrally secured to one lower side edge, and likewise includes a projecting portion 16 through which an aperture 17 is provided Thus, the flange 15 is designed for inserting between a pair of the ears 10, as can be seen in FIG. 2, with the bottom of the rod, as at 18, provided for inserting downwardly through an opening 19 that is provided within each adjacent cylindrical half, so that as the worker pulls forwardly upon the rod 14, its bottom edge 18, which may be knurled or serrated, as shown at 20, will bind against the feed tube F, and lock the packing removal tool in place, to prevent its being forced backwardly as when the stuffing box S and its packing P encounters the cutting edges 7 of the tool, during its application. Obviously there is adequate clearance between the ears 10 to accommodate the thickness of the flange 15.

Actually, during usage of the device, after it has been installed upon the feed tube F, as shown in FIG. 1, its piercing members 5 and 6, and more specifically its cutting edges 7, will be pressed into contact against the packing P, and then the carriage means for the soot blower will be actuated, for rearward movement, thereby forcing the packing P while turning against the cutting edges 7 of the tool, and provide immediately for a cutting and removal of the shavings of the packing material from within the stuffing box, and achieve a rather immediate removal of the entire packing from this location, without any need for the worker to actually come into contact with the stuffing box at this particular location. All the worker will be doing at this time is to hold onto the handle 14, pulling it forwardly, to lock it into position upon the feed tube, and prevent the tool from being forced rearwardly as a result of the rearward and turning movement of the stuffing box S, and its packing P, as it comes into contact with the cutting edges 7 of this particular tool.

Variations or modifications to the construction of this particular tool may become apparent to those skilled in the art upon reviewing the subject matter of this disclosure. For example, the tool of this structure may have application for removing packing from instruments other than furnaces. In any event, such variations or modifications, if within the spirit of this invention, are intended to be encompassed within the scope of any claims to patent protection issuing upon this invention. The description of the preferred embodiment set forth herein and as shown in the drawings is provided for illustrative purposes only.

Having thus described the invention what is claimed and desired to be secured by Letters Patent is:

1. A tool for use in removal of a packing embedded intermediate a first feed tube and a concentric-like second tube and which tubes are capable of moving longitudinally axially relative to each other, and with said packing normally being held by a stuffing box to effectively seal any pressurized air or the like within said tubes even during their select axial relative movement, the improvement which comprises, said tool incorporating a cylindrical-like member provided for being arranged adjacent one of said tubes and aligned with said packing, at least one piercing member projecting integrally and frontally from the said cylindrical-like member, said piercing member having a sharpened forwardmost edge and positioned for cutting into the packing upon movement of one tube and its packing towards said tool, said cylindrical-like member formed of a pair of semi-cylindrical halves, hinge means provided adjacent edges of said halves to hold said halves pivotally connected thereto, and fastening means securing proximate the opposite adjacent edges of said halves and useful for holding said cylindrical-like member around a tube, said cylindrical-like member having an opening therethrough, locking means operatively associated with the cylindrical-like member for securing said cylindrical-like member upon the first mentioned tube as its piercing member cuts into the packing, said locking member belong pivotally mounted to the cylindrical-like member, said locking member disposed for partially pivoting into said cylindrical-like member opening and being forced against the first mentioned tube to hold the tool fixed with respect to said tube during tool application, whereby as the second tube and its stuffing box arranged packing moves towards the said tool, the said tool piercing member cutting into said packing and removing the same from the stuffing box while the tool is held stationery through application of its locating member.

2. The invention of claim 1 and wherein said cylindrical-like member opening being provided between edges proximate the location of the fastening means for holding the cylindrical-like member about a tube during packing removal, and said locking means being pivotally mounted to the cylindrical-like member and disposed extending partially into the said edges arranged opening.

3. The invention of claim 2 and including a piercing member projecting from the front of each semi-cylindrical half of the cylinder like member.

4. The invention of claim 3 and wherein each piercing member extends helically from the front of each semi-cylindrical half.

5. The invention of claim 2 and wherein each fastening means including at least a pair of ears integrally connecting with and extending from the semi-cylindrical halves adjacent opposite edges thereof, each ear having an aperture provided therethrough, a bolt connector provided for extending through the aligned apertures of each ear and upon tightening securing the cylindrical like member about its supporting tube.

6. The invention of claim 5 and wherein there are two pairs-of-aligned ears extending from the adjacent edges of the semi-cylindrical halves of the cylinder like member.

* * * * *